United States Patent [19]

Granlund

[11] 4,338,146

[45] Jul. 6, 1982

[54] METHOD OF MANUFACTURING EMULSION EXPLOSIVE INSENSITIVE TO A #8 DETONATOR

[75] Inventor: Lars A. Granlund, Nora, Sweden

[73] Assignee: Nitro Nobel AB, Gyttorp, Sweden

[21] Appl. No.: 84,557

[22] Filed: Oct. 15, 1979

[30] Foreign Application Priority Data

Oct. 23, 1978 [SE] Sweden ..... 7811002

[51] Int. Cl.[3] ..... C06B 21/00

[52] U.S. Cl. ..... 149/109.6; 149/2; 149/60; 149/61

[58] Field of Search ..... 149/2, 2 F, 109.6, 60, 149/61; 102/23

[56] References Cited

U.S. PATENT DOCUMENTS

| | | | |
|---|---|---|---|
| 3,447,978 | 6/1969 | Bluhm | 149/2 |
| 3,765,964 | 10/1973 | Wade | 149/2 |
| 3,770,522 | 11/1973 | Tomic | 149/2 |
| 4,008,108 | 2/1977 | Chrisp | 149/2 F |
| 4,055,122 | 10/1977 | Muldrow, Jr. | 102/23 |
| 4,102,240 | 7/1978 | Cook et al. | 102/23 |
| 4,138,281 | 2/1979 | Olney et al. | 149/2 |
| 4,141,767 | 2/1979 | Sudweeks et al. | 149/2 |
| 4,218,272 | 8/1980 | Brockington | 102/23 |

*Primary Examiner*—Edward A. Miller

*Attorney, Agent, or Firm*—Hane, Roberts, Spiecens & Cohen

[57] ABSTRACT

A method of manufacturing an emulsion explosive which is insensitive to a number 8 detonator comprising forming a water solution of at least one oxidizing salt dispersed in a fuel such as oil, wax, urea, aluminum and the like and then heating the solution to a temperature of 70°-100° C. Thereafter gaseous particles are added to the heated solution both as an aid to detonation and as a co-emulsifier. Fuel with emulsifier dissolved therein is then added and emulsification takes place thereafter at relatively low stirring speed due to the presence of the co-emulsifier of gaseous particles and its introduction into the salt solution before any of the other components used for the explosive.

8 Claims, No Drawings

METHOD OF MANUFACTURING EMULSION EXPLOSIVE INSENSITIVE TO A #8 DETONATOR

FIELD OF THE INVENTION

The present invention relates to a method of manufacturing emulsion explosives which are insensitive to a detonator and are of the water-in-oil type with "hot spots" in the form of inorganic particles having gas enclosed or absorbed therein.

BACKGROUND AND PRIOR ART

The phrase "insensitive to a detonator" should be understood to mean that the explosives are not initiated by a conventional detonator no. 8.

Explosives of the water-in-oil-emulsion type generally contain one or more oxidizing salts such as ammonium nitrate, an oil and/or a wax, possibly other fuels such as urea, aluminium, etc. an emulsifier, possibly stabilizers for the emulsion such as guar rubber and gas bubbles or gas in closed cells.

Explosives of the water-in-oil-emulsion type are described in U.S. Pat. No. 3,447,978. The desired sensitivity is achieved by enclosing gas bubbles in the emulsion by means of a special process. Thus a water solution of oxidizing salts is emulsified in an oil phase, after which the emulsion is cooled and air is worked in mechanically or gaseous microballoons are introduced. The emulsification necessitates the use of high-speed mixers.

U.S. Pat. Nos. 3,674,578, 3,715,247 and 3,765,964 describe how detonator-sensitive emulsions of water-in-oil can be manufactured with the help of special sensitizers.

Swedish patent application No. 77 08 851-6 describes the manufacture of detonator-sensitive water-in-oil-emulsions without special sensitizers. In accordance with this application a salt solution is first emulsified in an oil phase, after which microspheres (gas-carriers) are added. This method of manufacture requires the use of high-speed mixers.

U.S. Pat. No. 4,008,108 describes a method of chemically producing the gas bubbles necessary for stable detonation.

Mixers with low speeds are used in the manufacture of conventional explosives. It is a great advantage if these mixers can also be used for manufacturing explosives of the water-in-oil-emulsion type.

It has long been known that small particles (zero fibres) facilitate emulsification.

SUMMARY OF THE INVENTION

Experiments using guar flour, colloidal silica, talcum and aluminium as a co-emulsifier were performed in connection with the development of the present invention. The result was negative in as much as oil-in-water-emulsion was obtained, that is to say, not the desired type of emulsion. Surprisingly enough, microspheres, as well as other gaseous particles which may be used as aids to detonation, appeared to act as a co-emulsifier and gave the desired emulsion type, i.e. water-in-oil-emulsion. It is of great practical importance that it was found that this emulsification could be performed in a conventional mixer with low speeds (120–200 rev/min). Examples of suitable microspheres are B15/250 from 3M Company, Q-cell 200 and Q-cell 300 from PQ Corporation. Other fine-particled inorganic materials used, with air enclosed or adsorbed therein are, for instance expanded perlite (pearlite, granular pearlite).

Low initiation-sensitivity increases the safety in handling and is of decisive importance in mechanized charging, such as pumping. The manufacturing process described below has been developed in order to produce emulsions of water-in-oil type having good detonation stability but which cannot be initiated by a detonator no. 8.

According to the present invention manufacture is performed by adding gaseous microspheres or other similar co-emulsifiers to a concentrated or oversaturated salt solution at a temperature of 70°–100° C. in a conventional mixer (120–200 rev/min). Oil is then added with emulsifier dissolved therein, the hydrophile-lipophile balance of the emulsifier being between 1 and 6. The mixture thus first forms an oil-in-water-emulsion which after several minutes of stirring inverts to a water-in-oil-emulsion. After this inversion the explosive is finished.

Examples of explosives and their composition, which have been manufactured in accordance with the process to which the invention relates, are shown in the following table 1. The compositions are not limited, however, to the mixtures given in the examples. The invention shall cover all such modifications to which the process is applicable.

Property data for the various compositions in table 1 can be found in table 2.

TABLE 1

| Components included | Ex 1 parts by weight | Ex 2 parts by weight | Ex 3 parts by weight | Ex 4 parts by weight | Ex 5 parts by weight | Ex 6 parts by weight |
|---|---|---|---|---|---|---|
| Ammonium nitrate | 335 | 335 | 335 | 335 | 335 | 335 |
| Calcium nitrate TQ 5 $Ca(NO_3)_2$ $NH_4NO_3$ 10 $H_2O$ | 400 | 400 | 400 | 400 | 400 | 400 |
| Sodium nitrate | 100 | 100 | 100 | 100 | 100 | 100 |
| Urea | 50 | 50 | 50 | 50 | 50 | 50 |
| Water | 40 | 40 | 40 | 40 | 40 | 40 |
| Highly refined diesel oil from Castrol Ltd | 52 | 52 | — | 52 | 52 | 52 |
| Liquid paraffin | — | — | 52 | — | — | — |
| Emulsifier sorbitane mono-oleate | 10 | 10 | 10 | 10 | 10 | 10 |
| Aluminium A80 Carlfors Bruk | — | — | — | 48 | — | — |
| Sensitizer/ co-emulsifier | 70 (Q-cell 300) | 50 (Q-cell 200) | 50 (Q-cell 200) | 50 (Q-cell 200) | 50 (exp. perlite) | 30 (B 15/250) |

TABLE 2

| | Ex 1 | Ex 2 | Ex 3 | Ex 4 | Ex 5 | Ex 6 |
|---|---|---|---|---|---|---|
| Energy MJ/kg | — | 2.73 | 2.73 | 3.69 | 2.73 | — |
| Gas volume $m^3$/kg | — | 0.73 | 0.73 | 0.67 | 0.67 | — |
| Oxygen balance % | — | +1.9 | +1.9 | ±0 | +1.9 | +1.9 |
| Density kg/$m^3$ | 1160 | 1180 | 1180 | 1180 | 1180 | 1180 |
| Detonation properties: | | | | | | |
| Initiation with detonator no. 8 | Miss | Miss | Miss | Miss | Miss | Miss |
| Initiation of explosive enclosed in iron pipe, 25 mm internal diameter, using explosive paste primer | Total denotation | Total detonation | Total detonation | Total detonation | Total detonation | Total detonation |
| Detonation velocity | — | 4500 m/s | — | — | — | — |

I claim:

1. A method of manufacturing an emulsion explosive which is insensitive to a no. 8 detonator and which comprises a water solution of at least one oxidizing salt dispersed in a fuel, an emulsifier, an emulsion stabilizer and a gas acting as an aid to detonation, the improvement comprising forming the water solution of the salt, heating the solution to a temperature of 70° to 100° C., thereafter adding gaseous particles both as an aid to detonation and as a co-emulsifier, then adding fuel with emulsifier dissolved therein and then effecting emulsification at a relatively low stirring speed due to said co-emulsifier of gaseous particles.

2. A method as claimed in claim 1 wherein emulsification is effected at a stirring speed less than 1000 rev/min.

3. A method as claimed in claim 1 wherein said gaseous particles used as the co-emulsifier and the aid to detonation form 1–10 percent by weight of the finished explosive.

4. A method as claimed in claim 1 wherein said salt in said water solution is ammonium nitrate, calcium nitrate or sodium nitrate.

5. A method as claimed in claim 4 comprising adding urea to the salt solution after the gaseous particles.

6. A method as claimed in claim 1 wherein the fuel is mineral oil.

7. A method as claimed in claim 1 wherein said emulsifier is added in the form of an emulsifier dissolved in oil and having a hydrophile-lipophile balance between 1 and 6.

8. A method as claimed in claim 1 wherein the composition has a density between 1050 and 1300 kg/$n^3$.

* * * * *